US005803146A

United States Patent [19]

Boon

[11] Patent Number: 5,803,146

[45] Date of Patent: Sep. 8, 1998

[54] MODULAR PARTITION SYSTEM

[76] Inventor: Karel Willem Boon, 4540 Promenade Paton, Laval, Quebec, Canada, H7W 4W6

[21] Appl. No.: 586,834

[22] PCT Filed: May 20, 1994

[86] PCT No.: PCT/CA94/00290

§ 371 Date: Jan. 17, 1996

§ 102(e) Date: Jan. 17, 1996

[87] PCT Pub. No.: WO95/32343

PCT Pub. Date: Nov. 30, 1995

[51] Int. Cl.[6] ..... A47G 5/00

[52] U.S. Cl. ..... 160/135; 160/231.2

[58] Field of Search ..... 160/135, 351, 160/229.1, 231.1, 231.2; 52/238.1, 239; 40/605, 606, 610

[56] References Cited

U.S. PATENT DOCUMENTS

| | | | |
|---|---|---|---|
| 4,166,332 | 9/1979 | Donovan | 160/135 X |
| 4,467,854 | 8/1984 | Godfrey | 160/135 |
| 4,830,080 | 5/1989 | Densen | 160/135 |
| 5,092,385 | 3/1992 | Beaulieu | 160/135 |
| 5,339,576 | 8/1994 | Fussler | 160/135 X |
| 5,450,694 | 9/1995 | Goranson et al. | 160/135 X |
| 5,486,391 | 1/1996 | Tyner | 160/135 X |

*Primary Examiner*—David M. Purol
*Attorney, Agent, or Firm*—McFadden Fincham

[57] ABSTRACT

A modular partition system comprising a pair of panels (12) united by a hinge. Each panel (12) includes a frame (18) constituted by rectilear frame members (18*a–d*) united in a non-collinear relationship. The frame members (18*a–d*) are releasably connected at mating ends by a set of fastener-free tongue and groove joints. The frame members (18*a–d*) have longitudinally extending channels (28) providing the frame with a continuous inwardly facing groove for receiving the peripheral edges of a flat panel member (20).

14 Claims, 3 Drawing Sheets

MODULAR PARTITION SYSTEM

FIELD OF THE INVENTION

The invention relates to a modular partition system that has a variety of applications such as subdividing office space, erecting temporary shelters, etc. The modular partition system is characterised by being lightweight, inexpensive to manufacture and easy to assemble.

BACKGROUND OF THE INVENTION

Temporary modular partition systems are used in a wide variety of business applications. A good example is exhibition halls where the area allocated to each participant is enclosed by an assembly of panels forming an individual booth. A booth design may require a considerable development effort from an aesthetical point of view and typically the owner would use the same booth in several presentation events that are scheduled at different geographical locations. Therefore, portability of the booth becomes an important design criterion.

The industry has developed a wide variety of partition systems, particularly for temporary usage, with the objectives in mind of providing the user with a low. cost product, that is portable and easy to assemble. Many of the proposed constructions, however, fall short of the intended objectives. In many instances, the assembly procedure is complicated because fasteners are used to join together various parts which requires from the owner to supply hand tools. Another drawback is the high cost and often excessive weight of such prior art modular partitions.

OBJECTIVE OF THE INVENTION

An object of the invention is a partition system that is inexpensive to manufacture, lightweight and that does not require fasteners such as screws or clamps for being assembled.

SUMMARY OF THE INVENTION

As embodied and broadly described herein, the invention provides a partition system comprising:

a pair of panels united to one another along adjacent edges, each said panel including:

a) a frame including a plurality of elongated frame members releasably connected in a non-collinear relationship at mating ends thereof to form a closed polygonal figure, first and second ones of said plurality of frame members including a transverse wall from which project two side walls in a spaced apart relationship defining therebetween an elongated channel that extends along a longitudinal axis of the frame member, one of said side walls including at an end portion thereof a projection extending toward the other of said side walls, a third of said plurality of frame members comprising end portions capable of engaging respective ones of said first and second frame members, each said end portions including a groove spaced from a respective extremity of said third frame member by a distance not exceeding a depth of said channel, thereby allowing to engage the end portions of said third member in said first and second frame members by mating the projections thereof in the grooves at the end portions of the third frame member;

b) a panel member having edge portions capable of slidingly engaging respective channels of said first and second frame members;

the frames of said panels including a pair of frame members united in a generally parallel relationship to one another for joining said panels together.

The partition system broadly defined above achieves the objectives of this invention by virtue of the tongue and groove connection between the frame members that allows an easy and fastener-free assembly of each panel. An interesting characteristic of the invention is the structural interrelationship between the frame and the panel member. The latter is stiff enough to rigidify the assembly and enable it to carry its intended weight.

The ability of the panel member to enhance the structural integrity of the structure allows to relax the manufacturing tolerances of the frame members making assembly still easier. Any excessive looseness in the tongue and groove joints that may develop as a result of wear will not compromise the stability of the panel structure since the stiff panel member significantly limits the angular movement between the frame members. Stated otherwise, even if the joints between the frame members are loose, once assembled the partition system acquires substantial rigidity.

In a most preferred embodiment, all frame members have a longitudinally extending channel that provides the frame of the panel with a continuous inwardly facing peripheral groove that receives the peripheral edge of the panel member.

Advantageously, the panels of the partition system include a pair of siamesed frame members united to one another in a parallel relationship by a hinge. This feature enables to vary the angular relationship between the panels. Preferably, the hinge is integrally formed with the companion frame members by a co-extrusion process in which synthetic materials having different flexibility when set are injected in physical admixture through a shaping die. The material selected to form the hinge is such as to allow a significant flexibility. In contrast, the material for making the companion frame members is rigid for enhancing the stability of the panels.

The partition system in accordance with the invention is modular in that it can be expanded by appending panels to one another. This is effected by installing siamesed frame members to join adjacent panels, instead of terminal units that connect to a single panel only.

As embodied and broadly described herein the invention provides a set of integrally formed frame members for joining panels together, comprising:

first and second frame members generally parallel to one another and in a spaced apart relationship, each frame member including:

a) a transverse wall; and b) two side walls projecting from said transverse wall in a spaced apart relationship and defining therebetween an elongated channel that extends along a longitudinal axis of the frame member, one of said side walls including at an end portion thereof a projection extending toward the other of said side walls, a web interconnecting said first and second frame members.

DESCRIPTION OP A PREFERRED EMBODIMENT

The present invention provides a novel partition system which is easily assembled without the need of hand tools nor fasteners, is lightweight and inexpensive to manufacture. Another advantage of the partition system resides in its modularity, thus allowing to expand the partition system as required by the specific application.

Figure 1:
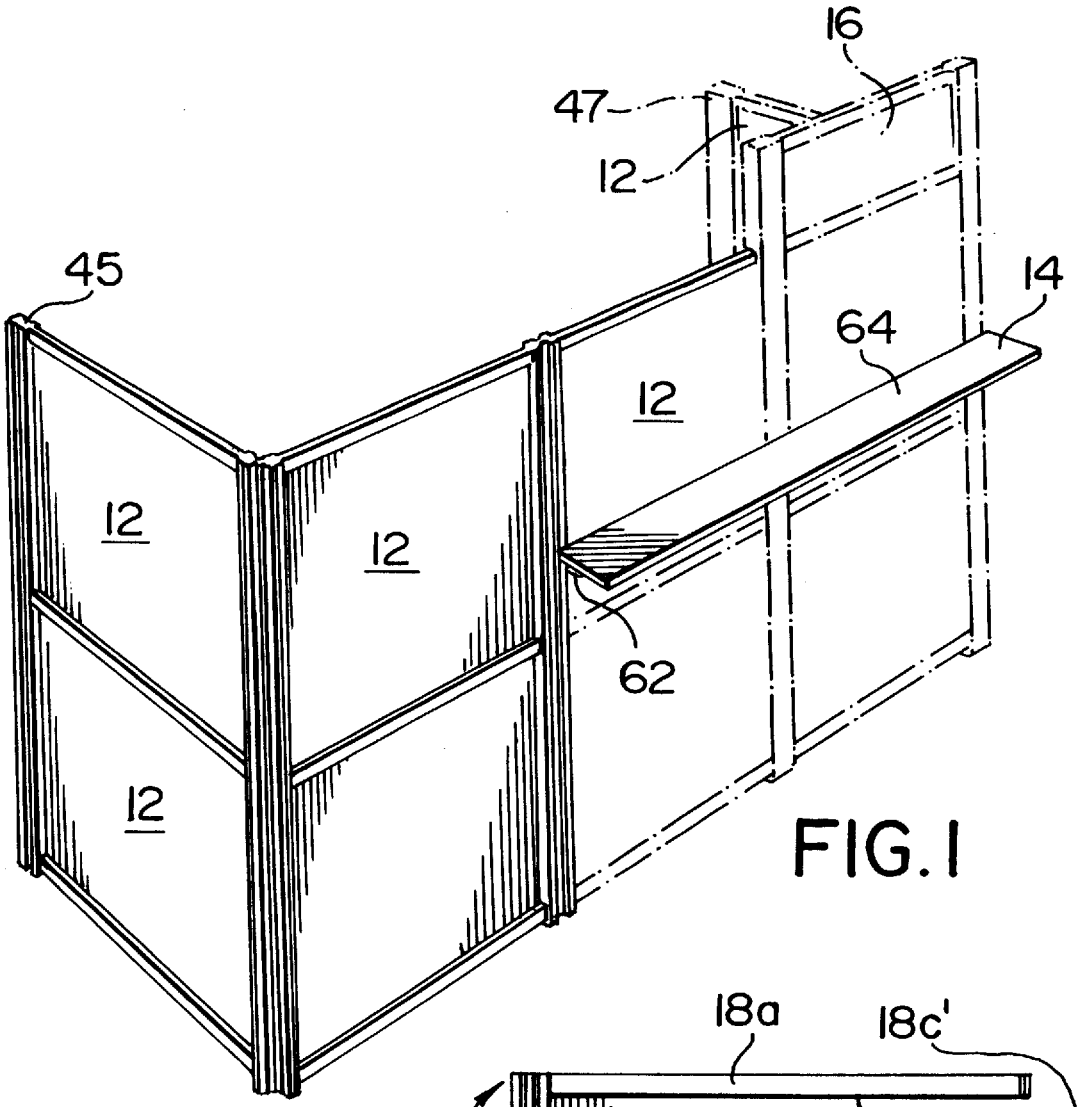
FIG. 1 is a perspective view of a modular partition system constructed in accordance with the present invention.
Figure 2:
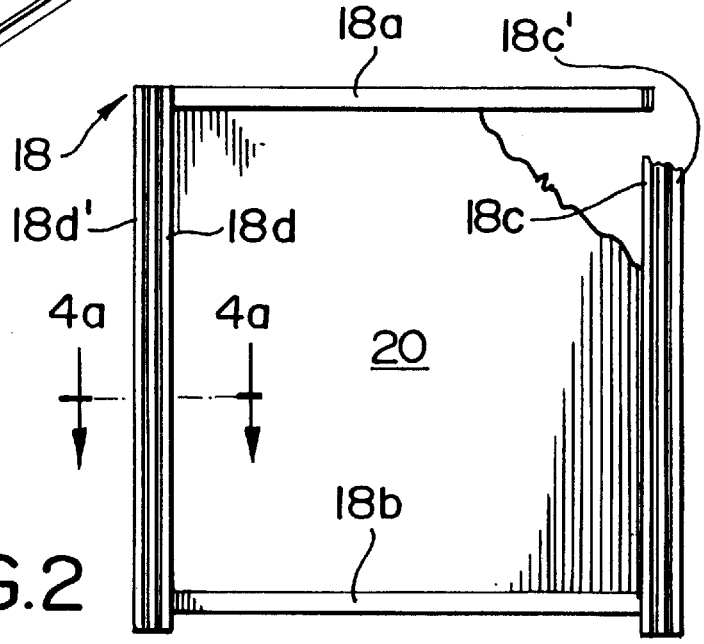
FIG. 2 is a side elevational view of a single panel from the modular partition system shown in FIG. 1.

FIG. 1 illustrates an example of the partition system that is designated comprehensively by the reference numeral 10. The partition 10 is an assembly of ten (10) panels 12 connected to one another by hinge joints that allow to vary the angular relationship between the panels. In the example shown, the panels 12 are vertically stacked in pairs, the hinge joints allowing to arrange the panels. pairs in the shape of a cubicle that has a main frontal wall, constituted by a trio of panel pairs in a co-planar relationship, and a pair of side walls formed by a single panel pair pivoted at right angle relative the main frontal wall.

The partition 10 is complemented by accessories such as a shelf 14 and a vertical extension 16 mounted on top of one of the panels 12.

Each panel 12 includes two main components, namely a polygonal frame 18, a rectangle for instance, and a flat panel member 20 mounted within the frame. Both the panel member and the frame are lightweight elements made preferably from synthetic materials that releasably. connect to one another in order to form a self-supporting comparatively rigid structure.

The polygonal frame 18 is comprised of frame members 18*a*, 18*b*, 18*c* and 18*d* connected at right angles to one another. As it will be discussed in detail later, the frame members 18*c* and 18*d* are conjoined with respective frame members 18*d*' and 18*c*' of adjacent panels to establish a structural link between the panels. This structural link may incorporate a hinge.

Figure 3:
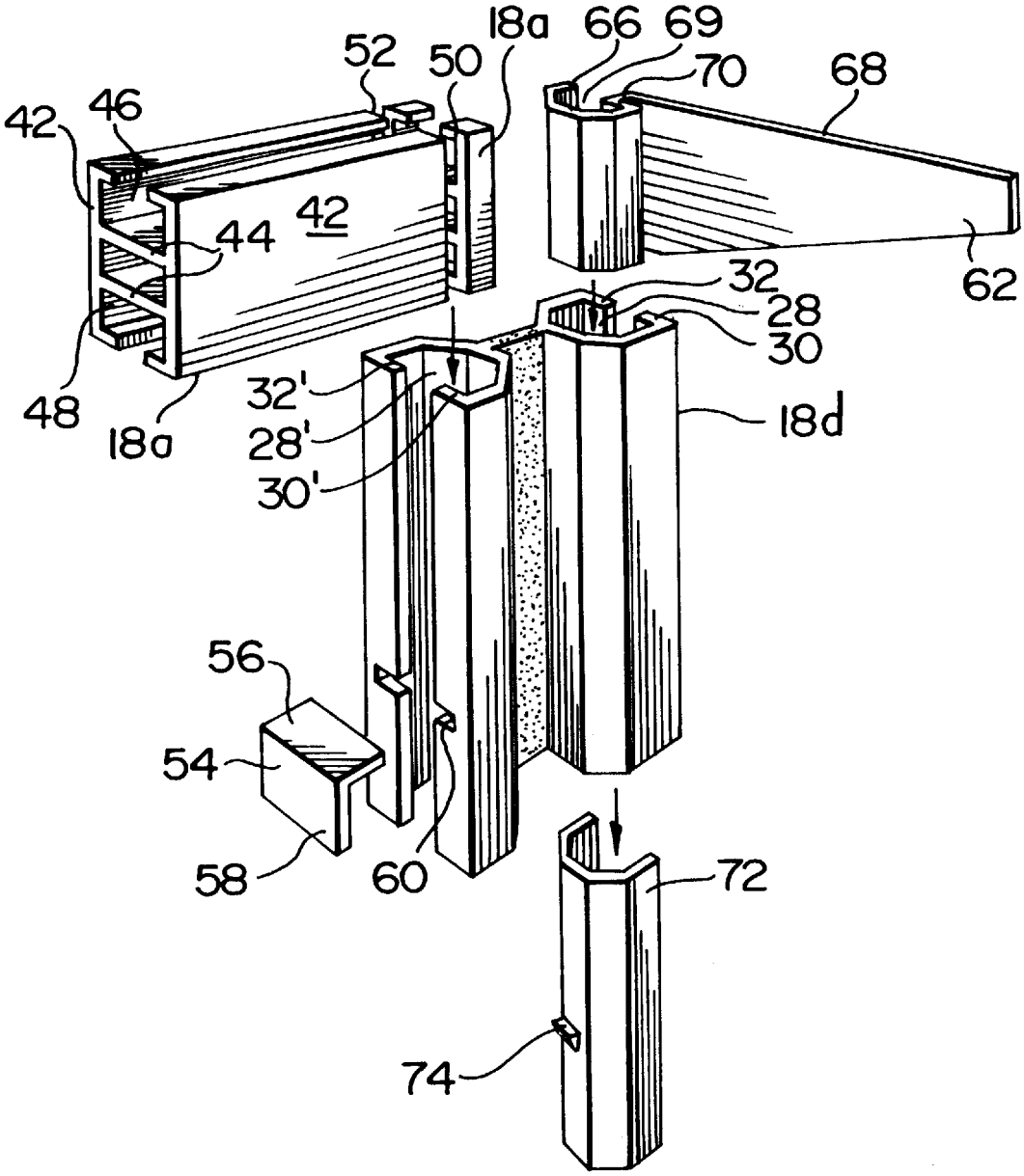
FIG. 3 is a fragmentary perspective exploded view of different frame members and accessories connected thereto, forming the framework of the modular partition system of FIG. 1.
Figure 4A:
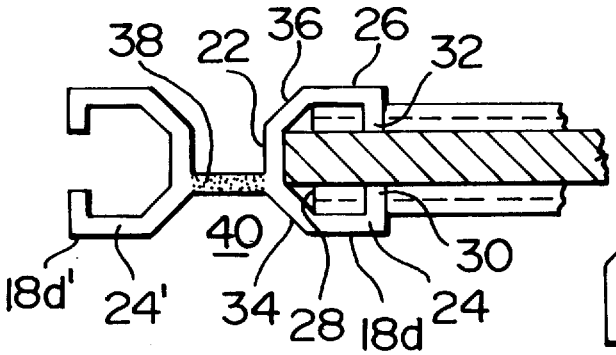
FIG. 4*a* is a cross-sectional view taken along lines 4*a*—4*a* in FIG. 2.
Figure 4B:
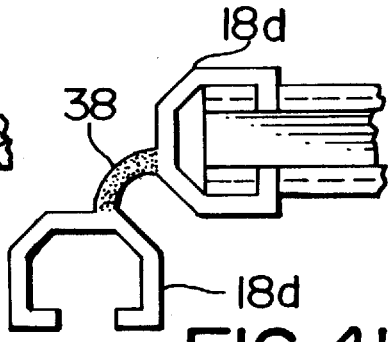
FIG. 4*b* is identical to FIG. 4*a* except the siamesed frame members are shown at a right angle relative to one another.

The structure of the siamesed frame members 18*d* and 18*d*' is best shown in FIGS. 3, 4*a* and 4*b*. The frame member 18*d* is U-shaped in cross-section, having a bottom transverse wall 22 and a pair of upstanding parallel side walls 24 and 26 in a spaced apart relationship defining therebetween a longitudinally extending channel 28. The upper edges of the side walls 24 and 26 are provided with co-planar projections 30, 32 that are orthogonal to side walls 24, 26 and extend toward one another to form the mouth of the channel 28. The bottom transverse wall 22 connects with side walls 24 and 26 through bevelled segments 34, 36.

The frame member 18*d*' has an identical construction and its components will be designated throughout the drawings by the same reference numerals followed by " ' ".

Figure 7:
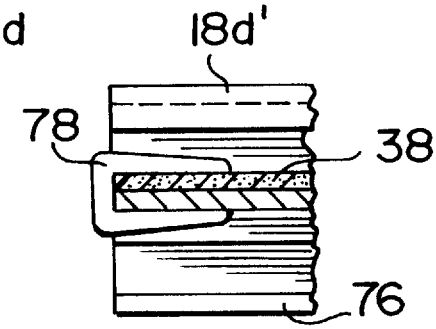
FIG. 7 is a cross-sectional view taken along lines 7—7 in FIG. 6.

A flexible web 38 interconnects the siamesed frame members 18*d* and 18*d*'. The web 38 constitutes a hinge allowing to locate the frame members 18*d* and 18*d*' at different angular relationships, as shown in FIG. 4*b*. It is important to note that the web 38 is offset toward the side walls 24, 24', i.e. the web 38 does not line-up with the mouths of channels 28 and 28'. The purpose of this feature is to form a recess 40 between web 38, and bevelled segments 34 and 34' that closely conforms to the outer configuration of a third frame member which is, identical to frame members 18*d* and 18*d*' and that can be nested therebetween, as shown in FIG. 7. The resulting trio of frame members is used to assemble panels in a T-shaped configuration as it will be described in greater detail later.

With reference to FIG. 3, the frame member 18*a* has a generally H-shaped cross-sectional configuration, including a pair of parallel side walls 42 interconnected by two centrally located webs 44. The side walls are transversely spaced apart defining therebetween an upper longitudinal channel 46 and a lower longitudinal channel 48. Each longitudinal end portion of the frame member 18*a* includes a pair of opposite grooves 50 and 52 that are essentially vertical cuts in the side walls 42. The grooves 50 and 52 extend at a right angle to the longitudinal axis of the frame member 18*a*. The grooves 50 and 52 are dimensioned to slidingly receive the projections 30' and 32' of frame member 18*d* and they are formed at a distance from the respective longitudinal edge of frame member 18*a* that does not exceed the depth of channel 28'. Similarly, the transverse dimension of the frame member 18*a* does not exceed the width of the channel 28'. As a consequence, the end portion of the frame member 18*a* can be inserted in the channel 28' by slidingly fitting the projections 30' and 32' in the grooves 50 and 52, respectively. The resulting right angle joint is relatively tight, yet easy to assemble/disassemble.

The frame member 18*b* is identical to frame member 18*a* described above.

Since the frame members 18*a*, 18*b*, 18*c* and 18*d* incorporate longitudinally extending channels, the resulting rectangular frame 18 has a continuous inwardly facing peripheral groove in which are engaged the peripheral edges of the flat panel member 20. The continuous peripheral engagement between the panel 20 and the frame provides a lightweight, yet comparatively rigid structure. It will also be noted that the dual channel (upper channel 46 and lower channel 48) structure of the frame members 18*a* and 18*b* provide the ability for a single horizontal frame member to receive the adjacent edges of two panel members 20 mounted vertically on top of one another, as shown in FIG. 1 for instance.

The modular partition 10 is assembled by first erecting the frame 18 of each panel. In this regard, the siamesed vertical frame members 18*c*/18*c*' and 18*d*/18*d*' are joined at their lower ends by a bottom horizontal frame member 18*b*. A panel member 20 is then slidingly inserted in the inwardly facing groove defined by these three frame members. To totally enclose the panel member 20 the upper horizontal frame member 18*a* is joined simultaneously to both vertical frame member pairs 18*c*/18*c*' and 18*d*/18*d*' and its lower channel 48 is fitted over the top edge of the panel member 20. At this point a second panel member 20 is inserted between the vertical frame member pairs 18*c*/18*c*' and 18*d*/18*d*' with the lower edge portion of the second panel member fitting in the upper channel 46 of the horizontal frame member 18*a*. The procedure is repeated until all the panel members required to vertically erect the panel 12 have been installed. Finally, a horizontal frame member is fitted between the upper ends of the vertical frame member pairs 18*c*/18*c* and 18*d*/18*d*' receiving in the lower channel 46 the upper edge of the uppermost panel member 20. The upper channel 46 of the top horizontal frame member remains empty.

To enhance the appearance of the partition system, the vertical end edges 45 and 47 of the panel arrangement are provided with terminal frame members which are identical to the frame members 18*d*, 18*d*', 18*c* or 18*c*' except that they are single units capable to engage a single panel member.

The disassembly procedure is similar and requires the removal of the top horizontal frame member to provide an access opening through which the panel member 20 can be pulled out. When all the panels 20 and the intermediate horizontal frame members have been removed, the lowermost horizontal frame member is separated from the vertical frame member pairs 18*c*/18*c*' and 18*d*/18*d*'. The components of the partition system can then be packaged for storage or transportation.

The modular partition system can be expanded from what is shown in FIG. 1 by appending more panels to the existing arrangement, either vertically or horizontally. The horizontal expansion is achieved simply by replacing a terminal frame member (at either edge 45 or 47) with a pair of siamesed frame members so as to link two panels together. The union may be provided with or without a hinge, as desired. The number of panels connected to one another is dependent upon the intended application. When the modular partition system is put to use as a booth, only a few panels would normally be required. Larger areas can be enclosed by putting more panels together. An interesting possibility is to assemble panels into a self-supporting arch configuration for building a roof. This feature allows to erect three-dimensional structures such as temporary shelters for example.

In order to enhance the functionality of the modular partition system in accordance with the invention various accessories can be integrated to the arrangement of panels. Referring to FIG. 3, a stopper clip 54 can be mounted to a vertical frame member (the frame member 18*d*' in the example shown) when desired to prevent the horizontal frame member 18*a* from being moved below a certain vertical level. The stopper clip 54 is of invert ed L-shape having a short horizontal leg 56 and a longer vertical leg 58. The horizontal leg 56 fits in a transverse slot 60 formed on the vertical frame member 18*d*' and extends within the channel 28' to form an abutment preventing the horizontal frame member 18*a* from moving downwardly any further. It will be apparent that the transverse slot 60 can be formed at any point intermediate the longitudinal extremities of the vertical frame members 18*d*', in accordance with the intended application. Typically the stopper clip is utilized when desired to provide a panel with a window like opening. This is achieved by maintaining a upper horizontal frame member with stopper clips 54 at each end in a vertically spaced apart relationship from a lower horizontal frame member, with no panel member between the two.

The shelving 14 is another example of an accessory that can be considered. It comprises a plurality of horizontal shelf brackets 62 (only one being shown in the drawings) connected to vertical frame members of the partition system for carrying a flat rectangular board 64 that could be used for displaying objects. The structure of the shelf bracket 62 is best shown in FIG. 3. The shelf bracket includes a base portion 66 having a shape corresponding to the internal configuration of the channel of any one of the vertical frame members (the channel 28 in the example shown). As a consequence, the base portion 66 is capable of slidingly fitting within the vertical frame member. The base portion 66 also includes a recess 69 in which fits the peripheral edge of the panel member 20. A projecting arm 68 on which the flat rectangular structure 64 rests, connects with the base portion 66 by the intermediary of a hook-like segment 70 defining a longitudinal passageway for receiving the projection 30.

The shelf brackets 62 are normally installed during the assembly of the partition 10. The individual shelf brackets are slidingly inserted in the respective vertical frame members and located at the proper elevation. The weight of the board 64 that is deposited on the projecting arms 68 induces a moment on the shelf bracket 62 which causes base portions 66 to slightly twist and bite the inner walls of the channels. As a result, the shelf brackets 62 are firmly locked in place. It should be noted that the binding effect of the base portions 66 increases with the weight of the board 64 and of the objects it supports.

Finally, a connector 72 is provided to longitudinally join vertical frame members. The connector has a U-shape in cross section and it is dimensioned to slidingly fit within the vertical frame members to be united to one another. An abutment 74 formed on the base wall of the connector limits the penetration of the connector in each frame member. By virtue of the U-shaped cross-section of the connector 72, the continuity of the channel 28 that receives the peripheral edge of a panel member 20 is maintained. The connector 72 is used to serially join vertical frame members in order to vertically expand the partition. This allows to ship the partition as a compact kit with relatively short vertical frame members that are assembled to full length when the partition is erected.

Figure 6:
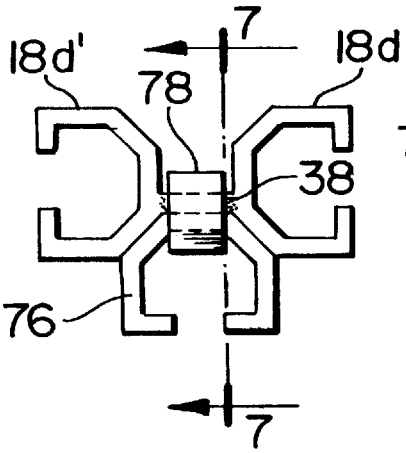
FIG. 6 is a top plan view of a trio of frame members for joining panels in a T-shaped configuration.

FIGS. 6 and 7 illustrate a variant of the invention featuring an assembly of vertical frame members having the ability of joining panels in a T-shaped configuration. The assembly of frame members has two components namely a pair of vertical siamesed frame members 18*d*/18*d*' and a single frame member 76 received in the recess 40. The offset of the web 38 toward one side of the frame members 18*d*/18*d*' allows to firmly abut the base wall of the single frame member 76 against the web 38 for a better stability. The vertical frame members are retained to one another by a resilient clip 78 straddling the web 38 and the base wall of the frame member 76. The resilient clip 76 is made of any suitable material such as metal or plastics.

Figure 5A:
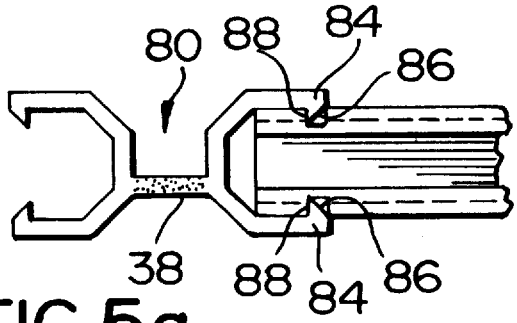
FIG. 5*a* is a cross-sectional view of a pair of siamesed frame members in accordance with a variant.
Figure 5B:
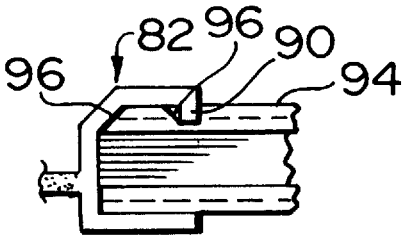
FIG. 5*b* is a cross-sectional view of a pair of siamesed frame members in accordance with a further variant.

FIGS. 5*a* and 5*b* illustrate variants of the frame members that we used for assembling the panels. In FIG. 5*a* the vertical siamesed frame members 80 are characterized by projections 84 on either side of the mouth of the longitudinal channel having slanted faces 86. This feature enables to insert a horizontal frame member (member 18*a* for instance) in the longitudinal channel by pressing the extremety of the horizontal frame member against the slanted faces 86 in order to resiliently spread them apart until the horizontal frame member is free to slide past the projections 84. Once fully inserted, the horizontal frame member cannot be pulled out by virtue of the locking relationship established between the non-camming undersurface 88 of the projections 84 and the grooves 50,52 receiving the projections.

Unlike the previously described vertical frame members that use dual projections to engage corresponding grooves in the horizontal frame members, the vertical frame member 82 of FIG. 5*b* has a single projection 90 received in a corresponding recess 92 of a horizontal frame member 94. The latter also includes a pair of camming surfaces 96 that can resiliently spread apart the projection 96 when engaging and disengaging the frame members 82 and 94.

The horizontal frame members 18*a* and 18*b* and the single vertical frame members 76 are manufactured from synthetic material, such as acrylonitrile butadiene styrene resin, polyvinyl chloride, polypropylene copolymers and polystyrenes by an extrusion process. Co-extrusion is the process of choice for producing the siamesed frame members of hard synthetic material integrally formed with a flexible hinge. As it is well known to those skilled in the art, the co-extrusion consists of feeding the materials having different properties in physical admixture through a shaping die. In the present case the material forming the web 38 is selected to posses a high flexibility so as to be able to be bent repeatedly without failing.

The panel member 20 is preferably flat. The panel member can also be curved, either horizontally, vertically or in both directions. Note that this embodiment requires frame members that either are pre-shaped to fit the panel tridimensional configuration or flexible enough to conform to the panel shape during the assembly of the partition. The material for manufacturing the panel member 20 should possess a sufficient stiffness as discussed earlier. Suitable materials are acrylics, acetates, wood and wood derivatives including wood laminates such as plywoods, lightweight metals and glass.

The above description of a preferred embodiment should not be interpreted in any limiting manner since variations and refinements are possible without departing from the spirit the invention. The scope of the invention is defined in the appended claims and their equivalents.

I claim:

1. A partition system comprising:

a pair of panels united to one another along adjacent edges, each said panel including:

a) a frame including a plurality of elongated frame members releasably connected in a non-collinear relationship at mating ends thereof to form a closed polygonal figure, first and second ones of said plurality of frame members including a transverse wall from which project two side walls in a spaced apart relationship defining therebetween an elongated channel that extends along a longitudinal axis of the frame member, one of said side walls including at an end portion thereof a projection extending toward the other of said side walls, a third of said plurality of frame members comprising end portions capable of engaging respective ones of said first and second frame members, each said end portions including a groove spaced from a respective extremity of said third frame member by a distance not exceeding a depth of said channel, thereby allowing to engage the end portions of said third member in said first and second frame members by mating the projections thereof in the grooves at the end portions of the third frame member;

b) a panel member having edge portions capable of slidingly engaging respective channels of said first and second frame members;

the frames of said panels including a pair of frame members united in a generally parallel relationship to one another for joining said panels together.

2. A partition system as defined in claim 1, wherein said panel member is engageable in said frame through an access opening established between said first and second frame members, said access opening being free for passage of said panel member in absence of said third frame member from said frame.

3. A partition system as defined in claim 1, wherein each said side walls includes a projection at an end portion thereof, the projections extending toward one another and defining a mouth of said elongated channel, said third frame member having at each end portion thereof a pair of opposite grooves capable of receiving said projections.

4. A partition system as defined in claim 3, wherein said grooves extend along respective axes that are non-collinear with a longitudinal axis of said third frame member.

5. A partition system as defined in claim 3, wherein said grooves extend along respective axes that are generally perpendicular to a longitudinal axis of said third member.

6. A partition system as defined in claim 1, wherein each one of said plurality of frame members has a longitudinally extending channel providing said frame with a continuous peripherally extending groove for receiving a peripheral edge portion of said panel member.

7. A partition system as defined in claim 1, wherein said panel member is generally flat.

8. A. partition system as defined in claim 1, wherein said panels are hingedly connected to one another.

9. A partition system as defined in claim 8, wherein said pair of frame members include a hinge integrally formed therewith.

10. A partition system as defined in claim 9, wherein said hinge is made of synthetic material significantly more pliable than a material of said pair of frame members.

11. A partition system as defined in claim 1, further comprising at least two shelf brackets for supporting a shelf, said shelf brackets being mounted to said first and second frame members, each shelf bracket including a base portion capable of slidingly engaging the elongated channel of the respective frame member and a shelf supporting arm projecting from said base portion, said base portion including an elongated recess for receiving a peripheral edge portion of said panel member when said panel member is mounted in said frame.

12. A partition system as defined in claim 1, wherein said projection has an oblique surface, said third member is capable upon engagement with said oblique surface to communicate a yielding motion to said one side wall as a result of sliding contact therewith in order to allow said third member to slide past said projection and enter said channel.

13. A partition system as defined in claim 1, wherein said third member has an oblique surface in vicinity of an end portion thereof, said oblique surface is capable upon engagement with said projection to communicate a yielding motion to said one side wall in order to allow said third member to slide past said projection and enter said groove.

14. A partition system as defined in claim 1, wherein said panel member is non-planar.

* * * * *